US010546563B1

(12) United States Patent
D'Addario et al.

(10) Patent No.: US 10,546,563 B1
(45) Date of Patent: Jan. 28, 2020

(54) VARIABLE TACK DRUMSTICK HANDLE

(71) Applicant: D'Addario & Company, Inc., Farmingdale, NY (US)

(72) Inventors: James D'Addario, Old Westbury, NY (US); Jason Talas, East Bernard, TX (US); Timothy Williams, Houston, TX (US); William Wurdack, St. Louis, MO (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 15/160,266

(22) Filed: May 20, 2016

(51) Int. Cl.
*G10D 13/02* (2006.01)
*G10D 13/00* (2006.01)

(52) U.S. Cl.
CPC ..... *G10D 13/003* (2013.01)

(58) Field of Classification Search
CPC ..... G10D 13/003
See application file for complete search history.

(56) References Cited

U.S. PATENT DOCUMENTS 1,484,777 A * 2/1924 Hassenpflug ..... G10D 13/003 84/422.4
4,462,296 A * 7/1984 Heiskell ..... G10D 13/003 84/422.4
4,488,470 A * 12/1984 Larrain ..... G10D 13/003 84/422.4
4,666,437 A * 5/1987 Lambert ..... A61L 29/085 427/2.28
4,719,836 A * 1/1988 Baumgart ..... G10D 13/003 84/422.4
D295,872 S * 5/1988 Koumarianos ..... 84/422.4
5,447,088 A * 9/1995 Mester ..... G10D 13/003 84/422.4
5,520,090 A * 5/1996 Eagle ..... G10D 13/029 84/411 P
6,069,308 A * 5/2000 Rabb ..... G10D 13/06 446/397
6,326,535 B1 * 12/2001 Pokallus ..... G10D 13/003 84/422.4
D556,820 S * 12/2007 Parikh ..... D17/22
7,514,618 B2 * 4/2009 Calato ..... G10D 13/003 84/422.1
8,389,842 B2 * 3/2013 Alleyne ..... B25G 1/102 84/422.4
D720,391 S * 12/2014 Cacciolo, Jr. ..... D17/22
D720,392 S * 12/2014 Cacciolo, Jr. ..... D17/22
D724,137 S * 3/2015 Cacciolo, Jr. ..... D17/22
(Continued)

FOREIGN PATENT DOCUMENTS

WO WO 8602849 A1 * 5/1986 ..... A63B 53/14

*Primary Examiner* — Robert W Horn
(74) *Attorney, Agent, or Firm* — Alix, Yale & Ristas, LLP

(57) ABSTRACT

A drumstick has a conventional tip and tapered shank, but the handle portion on the shaft has a wavy profile, with a nominal diameter and with the peaks rising above the nominal diameter and the valleys recessed below the nominal diameter. Whether or not the drumstick has a wavy handle, the outer surface of the drumstick has a tack which increases with increasing moisture of the drumstick outer surface, e.g., the tack increases between an initial condition of a drummer's dry skin against a dry drumstick surface and a play condition of a drummer's moist skin against a moist drumstick.

13 Claims, 1 Drawing Sheet

(56) References Cited

U.S. PATENT DOCUMENTS

| | | | | |
|---|---|---|---|---|
| D724,651 | S * | 3/2015 | Cacciolo, Jr. | D17/22 |
| 8,981,194 | B2 * | 3/2015 | Grossman | G10D 13/003 84/422.4 |
| 8,987,569 | B2 * | 3/2015 | Huber | G10D 13/003 84/422.4 |
| 9,111,512 | B2 * | 8/2015 | Richards | G10D 13/003 |
| 2001/0046559 | A1 * | 11/2001 | Hewitson | B05D 5/02 427/256 |
| 2006/0027073 | A1 * | 2/2006 | Richard | G10D 13/003 84/422.4 |
| 2012/0225997 | A1 * | 9/2012 | Niwa | C09J 7/0217 524/850 |
| 2013/0281596 | A1 * | 10/2013 | Mohan | C08L 23/16 524/427 |
| 2014/0216232 | A1 * | 8/2014 | Reid | G10D 13/003 84/411 R |
| 2015/0104635 | A1 * | 4/2015 | Klug | C08J 7/042 428/323 |
| 2016/0152872 | A1 * | 6/2016 | Furuta | C09J 9/00 428/141 |

* cited by examiner

VARIABLE TACK DRUMSTICK HANDLE

BACKGROUND

The present invention relates to drumsticks and in particular to improving the handle portion of drumsticks.

A number of prior art patent disclosures describe various shapes for drumstick handles or shafts, designed to enhance the ergonomic connection between the hands and the handle during vigorous play, Including:

U.S. Pat. No. 7,176,369
US 2012/0006179
US 2009/0084246
US 2008/0250911
US 2008/0184867
US 2006/0027073

Many drummers have found that no such shapes or profiles have been totally satisfactory, given the wide range of hand sizes and play styles.

Another deficiency experienced by most drummers, especially during vigorous performances under hot lights, is the reduction in tack or friction between the hands and the drumstick handle. Conventional sticks have a smooth finish at room temperature, which becomes slick during vigorous play as the temperature, humidity, and/or moisture level rise. The prior art includes providing a permanent tacky coating on the drumsticks. This tack is uncomfortably felt when the drumsticks are simply held in the hands and the friction or "holding power" felt between the hands and the drumsticks diminishes during vigorous play. A temporary application of a tacky material such as sold under the trademark "Gorilla Snot" can be used, but this builds up a residue on the drumstick and in any event the tack also diminishes during vigorous play.

SUMMARY

According to the present disclosure, the shape and/or surface properties of drumstick handles are improved for helping drummers better control the drumsticks during vigorous play.

From one aspect, the improved drumstick has a conventional tip and tapered shank, but the handle portion on the shaft has a wavy profile. This can be understood as having a nominal diameter with the peaks rising above the nominal diameter and the valleys recessed below the nominal diameter of the handle.

The nominal diameter of the handle is preferably constant, and the peaks and valleys are preferably uniform.

The handle can, however, be tapered with an increasing nominal diameter and the peaks and valleys rising and falling relative to such nominal diameter.

Furthermore, the diameters of the peaks and valleys can change along the length of the handle.

The variables of nominal diameter and larger and smaller diameters provide great flexibility for customization.

From another aspect, the improved drumstick comprises an outer surface having a tack which increases with increasing moisture of the drumstick.

Such increase in surface tack can arise between an initial condition of a drummer's dry skin against a dry drumstick surface and a play condition between a drummer's moist skin and a moist drumstick surface.

The drumstick preferably comprises a wooden handle, a layer of lacquer adhered to the handle, and a polymeric coating adhered to the layer of lacquer, wherein said coating is a composition including at least one pyrrolidone compound.

In the most effective embodiment, the drumstick handle has a way profile as described above, with an outer surface characterized by a tack or friction that increases during play.

DESCRIPTION

Figure 1:
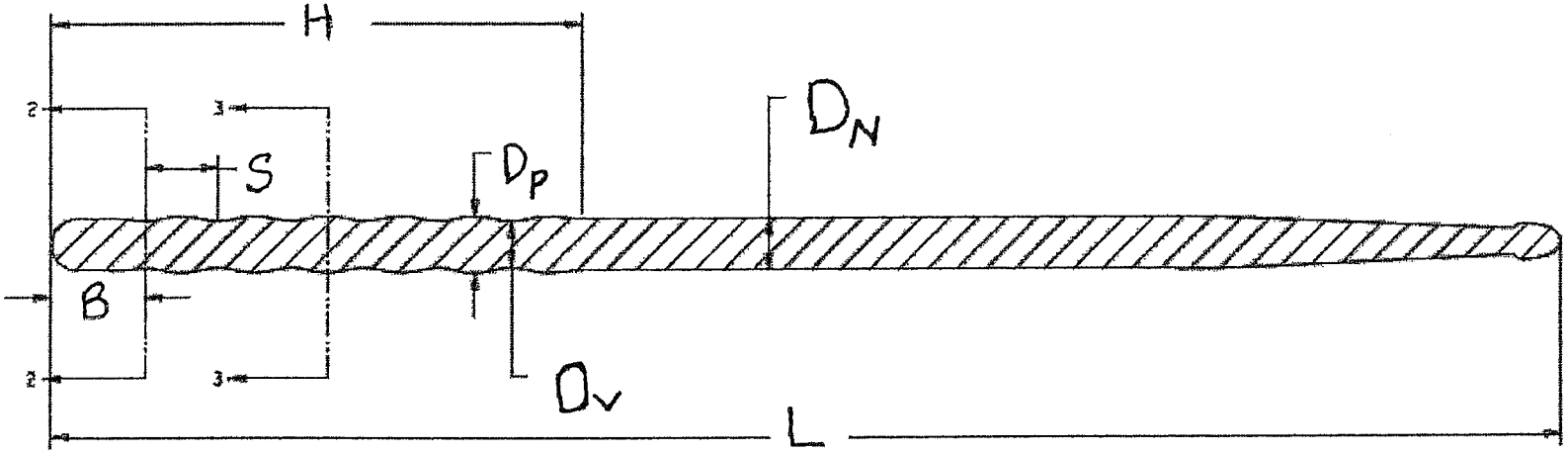
FIG. 1 is s longitudinal section view of a drumstick with a wavy handle according to an embodiment of the invention.
Figures 2, 3:
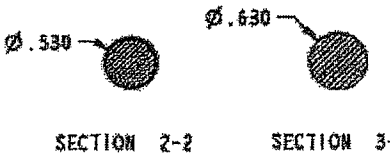
FIG. 2 is a cross section of the drumstick of FIG. 1, through a minimum diameter, valley portion of the wavy handle.
FIG. 3 is a cross section of the drumstick of FIG. 1, through a maximum diameter, peak portion of the wavy handle.

FIGS. 1-3 show a representative embodiment of a drumstick of length L, in which the nominal diameter Dn of the shaft (above the tapered portion) is constant all the way to the butt portion B and the diameters Dp and Dv of the peaks and valleys are uniform along most of the handle portion H of the shaft. The handle portion H can be considered as the upper half of the shaft portion. The transitions between the peaks and valleys are sinusoidal, i.e., symmetrical and periodic, with a period S. The wave profile need not extend all the way to the butt B, since the butt portion is not normally held in the fingers. This embodiment can be turned on a lathe.

From a general perspective, the drawing can be understood as showing a drumstick including a handle having a longitudinal axis and nominal diameter, wherein the improvement comprises that the handle has a wavy profile of peaks and valleys extending circumferentially around the axis, with the peaks at larger diameters than the nominal diameter and the valleys at smaller diameters than the nominal diameter.

For example, the nominal diameter can be 0.580 inch, with each valley at a smaller diameter of 0.530 inch and each peak at a larger diameter of 0.630 inch (as shown in the section views in FIGS. 2 and 3 taken at 2-2 and 3-3 of FIG. 1). The deviations from the nominal diameter would generally be in the range of 0.035 inch to 0.075 inch.

The handle portion can be considered the portion of the shaft that is held in the hand. The wave profile in FIG. 1 has five periods S or cycles, of about 0.800 inch, but four to six cycles of 0.750 to 1.00 inch are potentially useful.

In general, the profile as viewed from the side is preferably continuously curved, but not necessarily uniformly curved or periodic.

The drumstick according to another aspect has a wooden handle which may or may not be wavy, a layer of lacquer adhered to the handle, and a polymeric coating adhered to the layer of lacquer. Satisfactory coatings include at least one pyrrolidone compound which can be optionally substituted at any position on the ring structure. While the pyrrolidone compounds may be substituted at any ring position, preferred embodiments of the coating include a pyrrolidone compound substituted at the ring nitrogen with an alkyl group which may have between 1 and 10 carbon atoms. For example, ethyl and methyl pyrrolidone have demonstrated substantially notable results, with a preference for a composition that includes silicon dioxide, 1-ethyl-2-pyrrolidone, and carbon black. Such coating material is available from Walter Wurdack, Inc. (St. Louis, Mo.) as Black WB, under product code 15200-N.

The tack or friction characteristics of the Black WB coating were compared against a conventional lacquer coating on a drumstick from Promark Percussion, (J. D'Addario & Company, Inc., Farmingdale, N.Y.). For present purposes, the terms "tack", "friction", and "slip" are used interchangeably as referring to the tactile sensation of non-sliding surface connection between the fingers/hand and the drumstick surface.

An objective simulation was performed with bench tests as shown in Table 1, for comparing certain surface characteristics associated with an embodiment of the present invention (identified as "Active Grip" in Table 1) and a conventional Promark drumstick (identified as "Lacquer" in Table 1). The testing was designed to compare slip/coefficient of friction between two materials coated onto the drumstick handles.

TABLE 1

SIMULATION OF TACK FOR DRY AND DAMP CONDITONS

| | STATIC | | | DYNAMIC | | |
|---|---|---|---|---|---|---|
| DRY | DRY TEFLON RAMP | DRY TESLIN RAMP | DAMP TESLIN RAMP | DRY TEFLON RAMP | DRY TESLIN RAMP | DAMP TESLIN RAMP |
| LACQUER | 10 DEGREES | 13 DEGREES | 15 DEGREES | 10 DEGREES | 12 DEGREES | 15 DEGREES |
| ACTIVE GRIP | 30 DEGREES | 35 DEGREE | 45 DEGREES | 21 DEGREES | 25 DEGREES | 37 DEGREES |
| | STATIC | | | DYNAMIC | | |
| DAMP | DRY TEFLON RAMP | DRY TESLIN RAMP | DAMP TESLIN RAMP | DRY TEFLON RAMP | DRY TESLIN D RAMP | DAMP TESLIN RAMP |
| LACQUER | 10 DEGREES | 10 DEGREES | 13 DEGREES | 10 DEGREES | 10 DEGREES | 12 DEGREES |
| ACTIVE GRIP | 38 DEGREES | 43 DEGREES | 47 DEGREES | 35 DEGREES | 32 DEGREES | 37 DEGREES |

The simulation was made by placing a 3×3 inch aluminum plate on a ramp having a laminated surface of Teflon film and in a second series having a laminated surface of Teslin film. The aluminum plate was coated with either the Active Grip material or conventional lacquer. The Teflon does not absorb water and the micro porous silica filled Teslin plastic does absorb water. Teslin appears to have the feel of human skin both when wet and dry. The test samples were coated with a uniform diamond pattern to eliminate the unnatural condition of a smooth surface of the ramp material coming into contact with a smooth test plate surface. Thus, the plate surface represents the drumstick surface and the Teflon and preferably Teslin surfaces represent the drummer's skin.

Dry and damp conditions were tested. In the dry test, both the ramp surfaces and the coated aluminum plates were dry and not previously wet. In the damp test, either the ramp surface and/or coated aluminum plates were wetted and then dried before placement on the ramp. The damp conditions simulate moisture on the skin or drumstick surfaces, due primarily to the drummer's perspiration, especially in hot and/or humid environments.

The tests were conducted in both static and dynamic modes. In the static mode, the test plate was placed on the ramp, held in place for a moment, and then released. This was performed at successively decreasing angles of the ramp. The angle at which the plate did not slide from its position was recorded. The dynamic mode was similar to the static mode, except that the test plate was nudged to move slightly down the ramp and when it continued to slide on its own down the ramp the angle was recorded.

It was found that there was no difference in test results no matter how long the test plates were wetted before drying to dampness. The damp effect on the test plate lasted four minutes after drying for the active grip before it reverted to the non-damp test results. The damp effect on the lacquer test plate lasted only one minute before it reverted to the non-damp test results. One explanation is that the water is not really being absorbed into either of test plate coatings but rather water retention is on the surface at a microscopic level, with the active grip coating exhibiting a higher degree of micro porosity.

One can readily see from the subset of Table 1 shown in Table 2, that not only does the Active Grip resist slippage to a greater extent than the Lacquer under all test conditions, but that the slip resistance of the Active Grip increases in the damp plate condition relative to the dry plate condition on the dry Teslin ramp, whereas the slip resistance decreases for the damp Lacquer plate relative to the dry Lacquer plate on the dry Teslin ramp. Although during play the drumstick surface would likely not become moist while the drummer's skin remained dry, Table 2 nevertheless supports the novelty of a drumstick comprising an outer surface having a tack which increases with increasing moisture of the drumstick outer surface.

TABLE 2

SIMULATED COMPARISON BETWEEN DRY AND DAMP DRUMSTICKS

| PLATE COATING | PLATE SURFACE (STICK) | RAMP SURFACE (SKIN) | ANGLE @ STATIC | ANGLE @ DYNAMIC | COMMENT |
|---|---|---|---|---|---|
| LACQUER | DRY | DRY | 13 | 12 | DECREASED ANGLE |
| LACQUER | DAMP | DRY | 10 | 10 | FROM DRY PLATE TO DAMP PLATE |
| ACTIVE GRIP | DRY | DRY | 35 | 25 | 23% TO 74% ANGLE |

TABLE 2-continued

| SIMULATED COMPARISON BETWEEN DRY AND DAMP DRUMSTICKS | | | | | |
|---|---|---|---|---|---|
| PLATE COATING | PLATE SURFACE (STICK) | RAMP SURFACE (SKIN) | ANGLE @ STATIC | ANGLE @ DYNAMIC | COMMENT |
| ACTIVE GRIP | DAMP | DRY | 43 | 32 | INCREASE FROM DRY PLATE TO DAMP PLATE |

Importantly, the Active Grip not only provides significantly higher initial resistance to slippage (when both the ramp and plate are dry), but for the condition corresponding to vigorous play (both ramp and plate are damp), the resistance to slippage for the Active Grip plate surface increases whereas the resistance for the conventionally Lacquered surface remains constant. Table 3 shows the relevant subset from Table 1, which supports a drumstick comprising an exterior surface that increases in surface tack between an initial condition of a drummer's dry skin against a dry drumstick surface and a play condition between a drummer's moist skin and a moist drumstick surface.

TABLE 3

| SIMULATED COMPARISON BETWEEN REST AND PLAY CONDITIONS | | | | | |
|---|---|---|---|---|---|
| PLATE COATING | PLATE SURFACE (STICK) | RAMP SURFACE (SKIN) | ANGLE @ STATIC | ANGLE @ DYNAMIC | COMMENT |
| LACQUER | DRY | DRY | 13 | 12 | NO ANGLE CHANGE |
| LACQUER | DAMP | DAMP | 13 | 12 | FROM DRY TO DAMP |
| ACTIVE GRIP | DRY | DRY | 35 | 25 | 34% TO 48% ANGLE |
| ACTIVE GRIP | DAMP | DAMP | 47 | 37 | INCREASE FROM DRY TO DAMP |

Table 4 shows the results of a subjective test by a musician, who performed with each of two sets of previously unused drumsticks that were identical except that one set was a conventional lacquer coated Promark another set was similar pair coated with lacquer and then the Active Grip according to an embodiment of the present invention. Each set of drumsticks was played for five minutes, with the drummer announcing to a record keeper the subjective degree of tack or friction the drummer felt, starting at time zero and at one minute intervals thereafter. The room ambient environment and vigor of the drumming was such that over the course of five minutes the drummer's hands started sweating, and the musician sensed development of heat.

TABLE 4

| USE TEST AT AMBIENT ROOM CONDITIONS | | | | |
|---|---|---|---|---|
| CASE | CONTINUOUS PLAY TIME (MIN) | INVENTION SCALE 0-3 0 BEING NO TACK OR HEAT | CONTROL SCALE 0-3 0 BEING NO TACK OR HEAT | COMMENT PER INVENTION. NO CHANGE IN FEEL FOR CONTROL TEST OVER 5 MINUTES PLAYING. |
| 1 | 0 | 0 | 0 | INVENTION FEELS LIKE SOFT TOUCH FINISH. NO ADDED GRIP FELT BY THE DRUMMER |
| 2 | 1 | 0 | 0 | MINIMAL ADDED GRIP FELT BY INVENTION. STARTING TO FEEL MORE TACKY |
| 3 | 2 | 1 | 0 | NOTICEABLE DIFFERENCE IN TACK. STARTING TO HEAT UP IN THE PLAYERS HAND |
| 4 | 3 | 2 | 0 | HEAT IS INTENSIFYING AND TACK IS BECOMING STRONGER |
| 5 | 4 | 3 | 0 | TACK IS IDEAL FOR LONG PERFORMANCE TIMES AND SWEATY PALMS. ADDED CONFIDENCE IN BEING ABLE TO HOLD ON TO THE STICK WITHOUT OVER SQUEEZING OR GRIPPING THE STICK. THIS IS ADDING TO THE PLAYERS STAMINA AND CONFIDENCE. |
| 6 | 5 | 3 | 0 | SAME AS MINUTE 4 |

The invention claimed is:

1. A drumstick comprising an outer surface with a coating of Black WB thereon, wherein the Black WB coating comprises silicon dioxide, 1-ethyl-2-pyrrolidone and carbon black, and the Black WB coating causes a tack on the outer surface of the drumstick to increase between an initial condition of a drummer's dry skin against a dry drumstick surface and a play condition of a drummer's moist skin against a moist drumstick.

2. The drumstick of claim 1, wherein said drumstick has a wavy handle and said coating of Black WB is on said wavy handle.

3. The drumstick of claim 1, wherein the handle is wood with a wavy profile, a layer of lacquer is adhered to the wood handle, and the coating of Black WB is adhered to the layer of lacquer.

4. A drumstick comprising:

a tip;

a tapered shank extending from the tip; and a shaft extending from the shank to a butt, wherein the shaft includes a handle portion having a nominal diameter and a wavy profile of peaks with larger diameters than the nominal diameter and valleys with smaller diameters than the nominal diameter, and the portion of the handle having said wavy profile is coated with a Black WB coating comprising silicon dioxide, 1-ethyl-2-pyrrolidone and carbon black.

5. The drumstick of claim 4, wherein the nominal diameter is constant.

6. The drumstick of claim 4, wherein the peaks and valleys have diameters that differ from the nominal diameter within the range of 0.035 inch to 0.075 inch.

7. The drumstick of claim 4, wherein the wavy profile is sinusoidal.

8. The drumstick of claim 4, wherein the wavy profile extends over at least four cycles of peaks and valleys.

9. The drumstick of claim 4, wherein the diameters of the peaks and valleys differ from the nominal diameter by the same distance.

10. The drumstick of claim 4, wherein the profile is continuously curved.

11. A drumstick comprising an outer surface with a coating thereon, wherein the coating comprises silicon dioxide, 1-ethyl-2-pyrrolidone and carbon black.

12. The drumstick of claim 11, wherein the handle is wood, a layer of lacquer is adhered to the wood handle, and the coating is adhered to the layer of lacquer.

13. The drumstick of claim 12, wherein handle has a wavy profile.

* * * * *